US011236644B1

(12) United States Patent
Kamble et al.

(10) Patent No.: US 11,236,644 B1
(45) Date of Patent: Feb. 1, 2022

(54) SYSTEM AND METHOD FOR ROCKER ASSEMBLY

(71) Applicant: Powerhouse Engine Solutions Switzerland IP Holding GmbH, Zug. (CH)

(72) Inventors: Sandeep Kamble, Bangalore (IN); Dattatraya Somnath Bhagoji, Bangalore (IN)

(73) Assignee: Powerhouse Engine Solutions Switzerland IP Holding GmbH, Zug (CH)

( * ) Notice: Subject to any disclaimer, the term of this patent is extended or adjusted under 35 U.S.C. 154(b) by 0 days.

(21) Appl. No.: 17/219,478

(22) Filed: Mar. 31, 2021

(30) Foreign Application Priority Data

Jul. 16, 2020 (IN) ..... 202041030366

(51) Int. Cl.
*F01L 1/18* (2006.01)
*F01L 1/14* (2006.01)
*F01M 9/10* (2006.01)

(52) U.S. Cl.
CPC ..... *F01L 1/181* (2013.01); *F01L 1/146* (2013.01); *F01M 9/105* (2013.01); *F01M 9/107* (2013.01)

(58) Field of Classification Search
CPC ..... F01L 1/146; F01L 1/181; F01M 9/105; F01M 9/107
USPC ..... 123/90.36, 90.39, 90.61
See application file for complete search history.

(56) References Cited

U.S. PATENT DOCUMENTS

| | | | | | |
|---|---|---|---|---|---|
| 2,957,461 | A * | 10/1960 | Kane | F02B 75/22 | 123/54.7 |
| 4,724,805 | A * | 2/1988 | Wirth | F01L 1/181 | 123/90.39 |
| 5,577,470 | A * | 11/1996 | Leydorf, Jr. | F01L 1/181 | 123/193.5 |
| 6,041,750 | A * | 3/2000 | Miller | F01L 1/053 | 123/193.5 |
| 6,895,925 | B2 * | 5/2005 | Hannon | F01L 1/146 | 123/310 |
| 7,156,059 | B2 * | 1/2007 | Yokoyama | F01L 1/267 | 123/90.16 |
| 8,087,391 | B2 * | 1/2012 | Tores | F01L 1/181 | 123/90.41 |
| 10,001,035 | B2 * | 6/2018 | Cecil | F01L 1/181 | |
| 10,408,094 | B2 * | 9/2019 | VanWingerden | F02D 13/0203 | |
| 2002/0092490 | A1 * | 7/2002 | Harada | F01L 1/024 | 123/90.27 |
| 2005/0061274 | A1 * | 3/2005 | Nakahira | F01L 1/46 | 123/90.16 |
| 2017/0089231 | A1 * | 3/2017 | Kisaichi | F02B 75/16 | |
| 2019/0055858 | A1 * | 2/2019 | Bogdanski | F01L 1/181 | |

OTHER PUBLICATIONS

"Koenig Expander® MB Sealing technology," YouTube Website, Available Online at https://www.youtube.com/watch?v=zcCnGM4ih64, Jun. 21, 2015, 4 pages.

(Continued)

*Primary Examiner* — Jorge L Leon, Jr.
(74) *Attorney, Agent, or Firm* — McCoy Russell LLP

(57) ABSTRACT

Systems and methods for an engine are provided. The engine includes a straight rocker shaft passing through each of a first rocker arm and a second rocker arm, the first rocker arm being shaped differently from the second rocker arm.

18 Claims, 9 Drawing Sheets

(56) References Cited

OTHER PUBLICATIONS

Kamble, S. et al., "An Ornamental Design for a Rocker Shaft," U.S. Appl. No. 29/739,807, filed Jun. 29, 2020, 8 pages.
Kamble, S. et al., "An Ornamental Design for a Rocker Arm," U.S. Appl. No. 29/739,813, filed Jun. 29, 2020, 9 pages.
Kamble, S. et al., "An Ornamental Design for a Rocker Pedestal," U.S. Appl. No. 29/739,815, filed Jun. 29, 2020, 9 pages.

* cited by examiner

SYSTEM AND METHOD FOR ROCKER ASSEMBLY

CROSS REFERENCE TO RELATED APPLICATIONS

The present application claims priority to Indian Patent Application No. 202041030366, entitled "SYSTEM AND METHOD FOR ROCKER ASSEMBLY", and filed on Jul. 16, 2020. The entire contents of the above-listed application are hereby incorporated by reference for all purposes.

BACKGROUND

Technical Field

Embodiments of the subject matter disclosed herein relate to a straight rocker shaft connecting two rocker arms of an engine cylinder.

Discussion of Art

Internal combustion engine systems such as in a locomotive engine, rocker arm assemblies are used for valve operating mechanisms. Each engine cylinder may include a first rocker assembly coupled to a valve stem of an intake valve and a second rocker assembly coupled to another valve stem of an exhaust valve. Based on valve timing, in order to open and close the valves, the first rocker assembly and the second rocker assembly may oscillate about a shared rocker shaft passing through respective openings in each of the two rocker assemblies. A rocker pedestal may support portions of the rocker shaft not passing through the openings of the rocker assemblies.

A bent rocker shaft having a uniform oval cross-section (to match the shape of the opening of the rocker arms) may be challenging to repair or replace. Due to the difficulty in manufacturing, the variability of the produced parts may increase. Further, to support the bent rocker shaft, manufacturing of the rocker pedestal with pillars of varying heights may be challenging. It may be desirable to have a system and method that differs from those that are currently available.

BRIEF DESCRIPTION

In one embodiment, a system for an engine may include a straight rocker shaft passing through each of a first rocker arm and a second rocker arm, the first rocker arm being shaped differently from the second rocker arm.

BRIEF DESCRIPTION OF THE FIGURES

FIGS. 2-8B are shown to scale, although other relative dimensions may be used, if desired.

DETAILED DESCRIPTION

Figure 1:
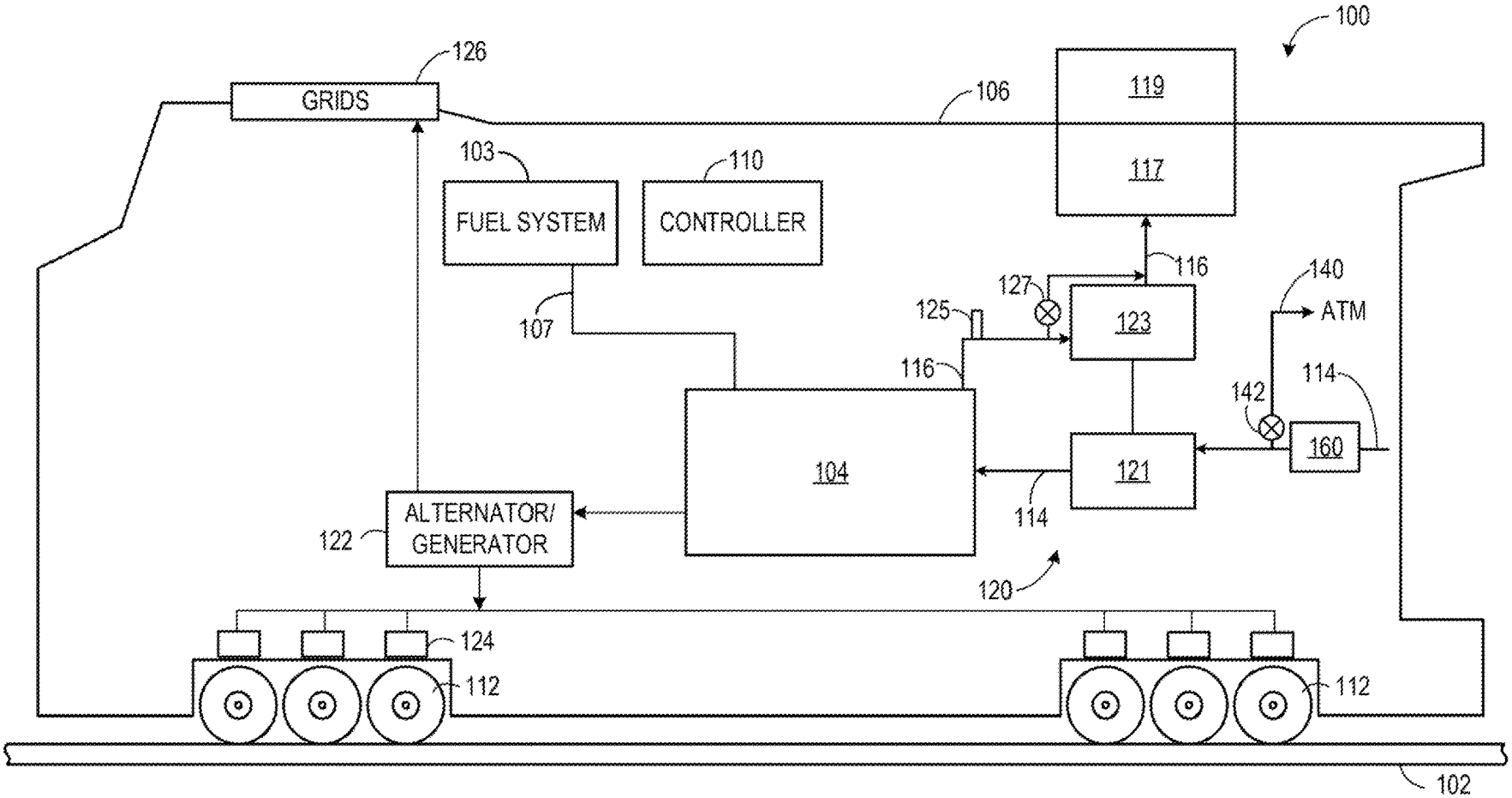
FIG. 1 shows a schematic diagram of a vehicle including an internal combustion engine, according to an embodiment of the invention.

The following description relates to embodiments of a system for a straight rocker shaft connecting two rocker arm assemblies of an engine cylinder. In one embodiment, a cylinder may be coupled to a first rocker arm assembly and a second rocker arm assembly with a first rocker arm coupled to the intake valve and a second rocker arm coupled to an exhaust valve. Each rocker arm may have a straight portion and an opening formed directly below the straight portion. The first rocker arm and the second rocker arm may oscillate about a shared rocker shaft passing through openings in each rocker arm based at least in part on valve timing. In a system where the first rocker arm may be similar to, or identical to, the second rocker arm given the positioning of the cylinder valves and the corresponding rocker arms, the rocker shaft may be formed as a bent shaft in order to pass through both the openings of the two rocker arms. A rocker pedestal with pillars of varying heights may be provided, and thereby to provide structural support to the bent rocker shaft. In one example, a rocker arm assembly may include a system for an engine. The engine may include a straight rocker shaft passing through each of a first rocker arm and a second rocker arm. The first rocker arm may be shaped differently from the second rocker arm. A straight rocker shaft may pass though openings of both rocker arms coupled to cylinder.

In one embodiment, in the engine a first rocker arm may be coupled to an intake valve of a cylinder and may be shaped differently from a second rocker arm that may be coupled to an exhaust valve of the same cylinder. The first rocker arm may have an inclined upper portion with a first opening formed directly below the inclined portion, the inclined upper portion not perpendicular to an axis of the first opening. The second rocker arm may have a straight upper portion with a second opening formed directly below the straight portion, the straight upper portion may be perpendicular to a central axis of the second opening. The first opening and the second opening may be co-axial and a straight rocker shaft may pass through each of the first opening and the second opening, thereby coupling the first rocker arm and the second rocker arm. Based on valve timing, each of the first rocker arm and the second rocker arm may oscillate about the shared rocker shaft. A rocker pedestal with two pillars of equal height may support portions of the rocker shaft not enclosed by the rocker arm openings. Lubricating oil may be supplied to the rocker arms via channels within the pillars of the rocker pedestal and rocker shaft.

By forming a rocker arm with an included upper portion, a straight rocker shaft may be accommodated within two rocker arms of two valves of a cylinder. A technical effect of this may be that manufacturability of the straight rocker shaft may be improved and the component may be cost efficient to produce. By using an inclined rocker arm and a straight rocker shaft, packaging of the rocker arm assemblies in the cylinder head may be improved. A technical effect of using a rocker arm with an inclined upper portion is that the rocker arm may have improved stiffness and lower inertia and mass, as desired. By supporting the rocker shaft at a single plane via the rocker pedestal, complexity of the layout may be reduced and fewer components may be needed to supply lubricating oil through the pillars of the rocker pedestal and rocker shaft.

Engine systems according to embodiments of the invention may be suitable for use in mobile applications and stationary applications. Suitable stationary applications may include stationary power generation applications. Suitable mobile applications may include vehicles, such as may be used in the rail, mining, marine, aviation, trucking, and related industrial markets. A locomotive that is configured for the rail market is used herein for illustration purposes. The rail market may include mainline freight haulage, passenger rail, switchers, shunters, and the like.

Figure 2:
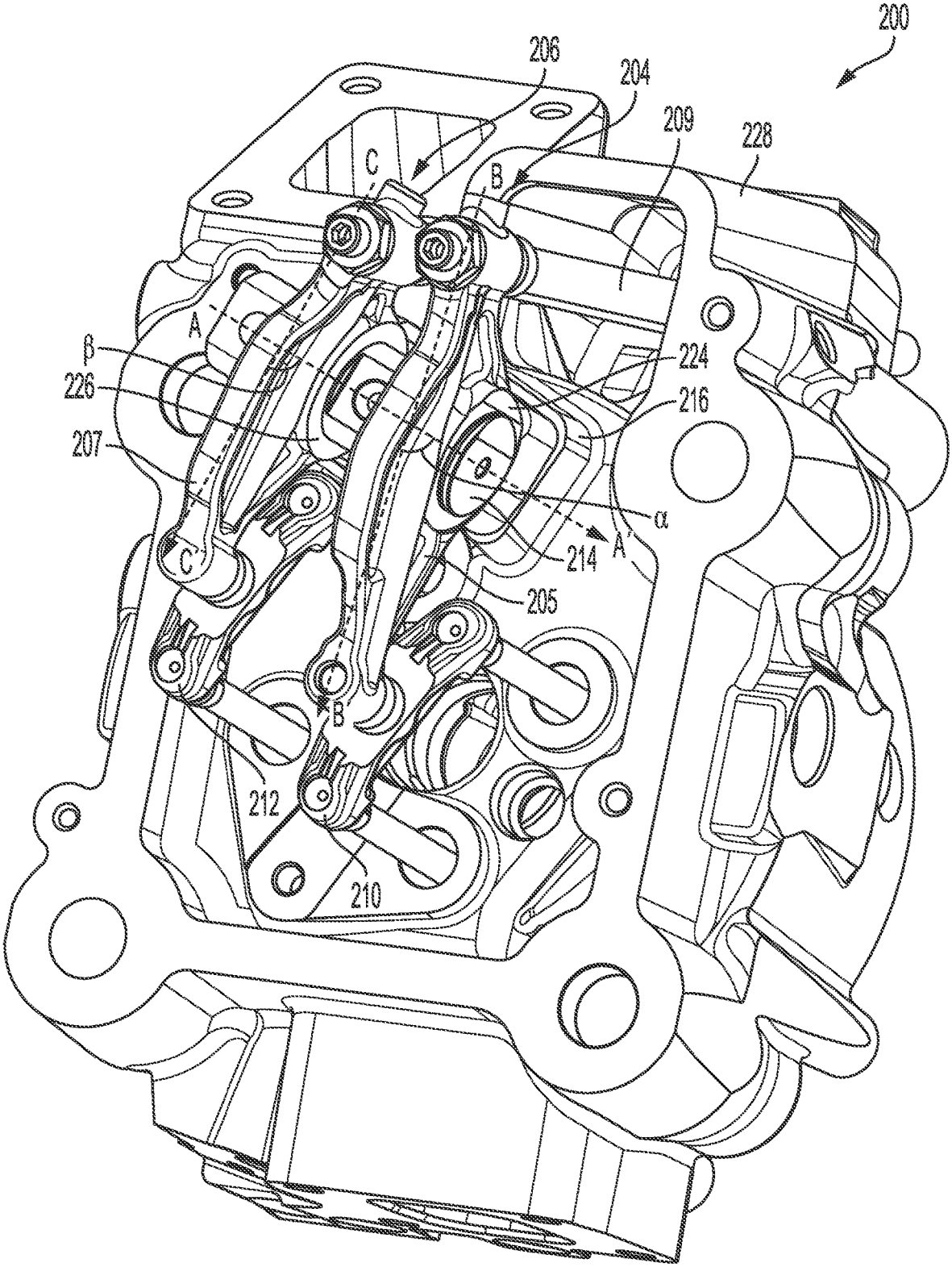
FIG. 2 shows a perspective view arrangement of rocker assemblies including a straight rocker shaft.
Figure 3:
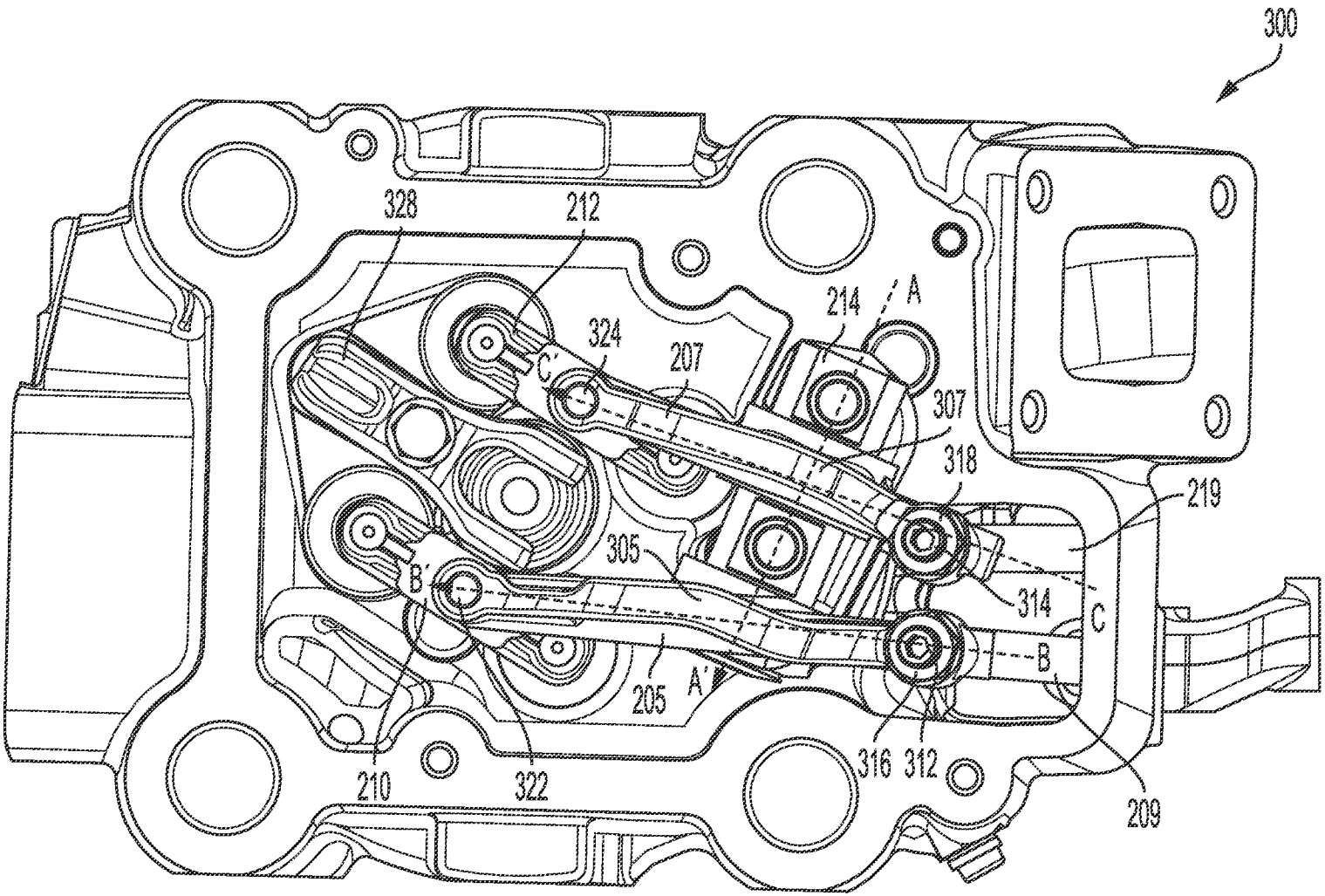
FIG. 3 shows a top-view of the rocker assemblies of FIG. 2.
Figure 4:
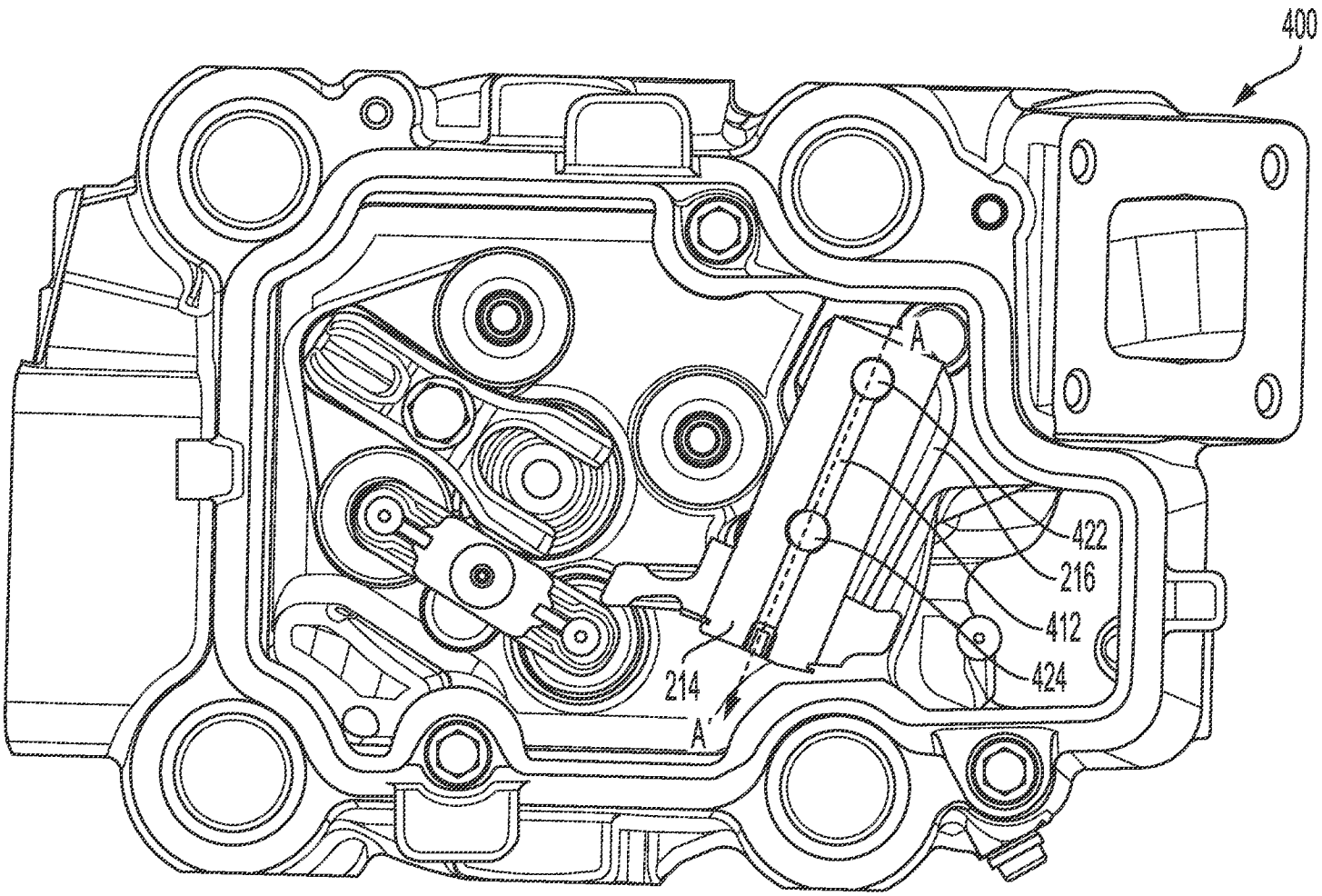
FIG. 4 shows a cross-section of the top-view of the rocker assemblies of FIG. 3.
Figure 7:
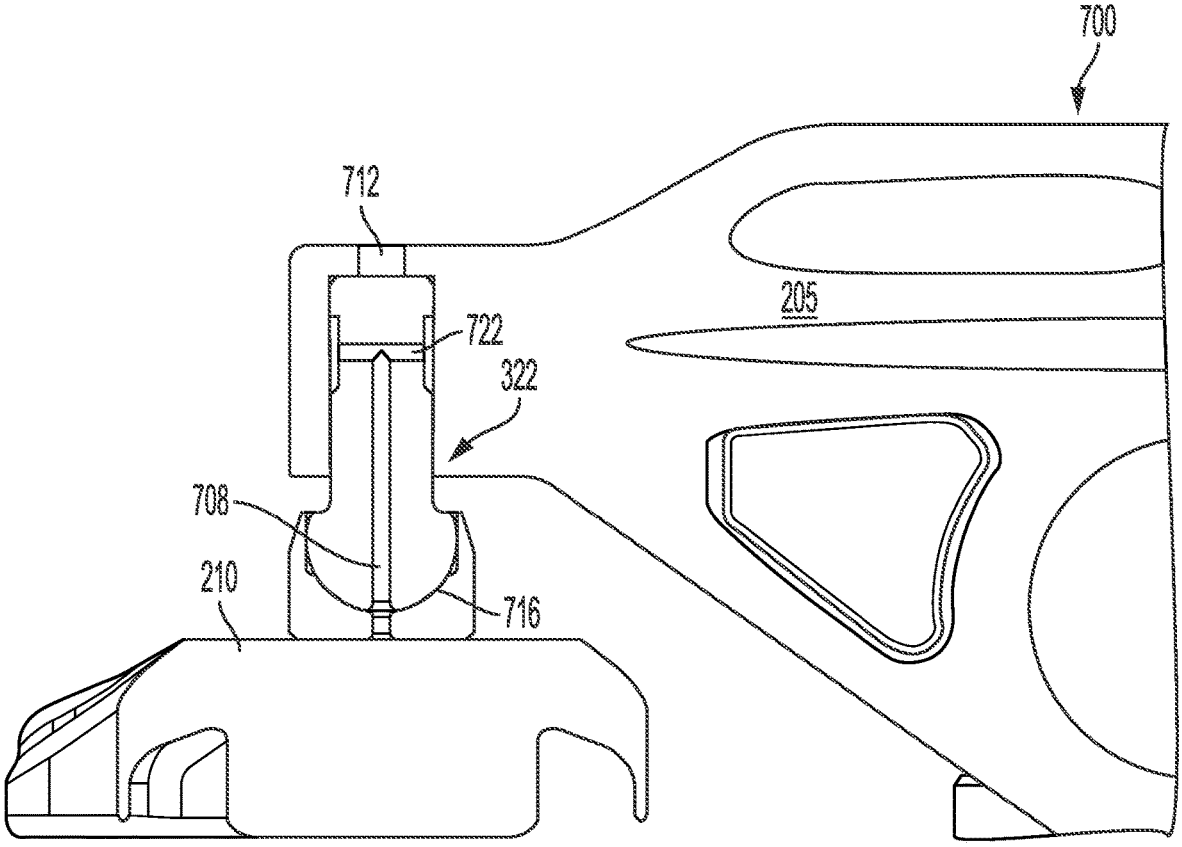
FIG. 7 shows an example valve side elephant foot assembly coupled to a rocker arm.
Figure 8A:
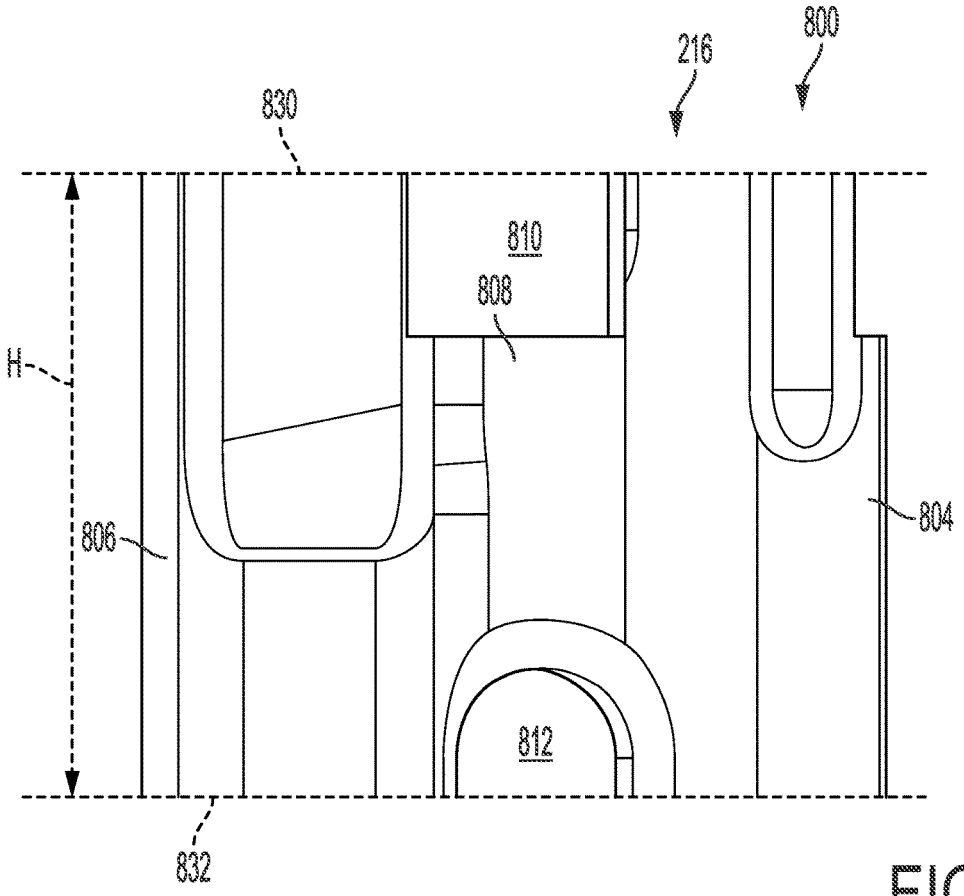
FIG. 8A shows a front view of a rocker pedestal supporting the straight rocker shaft of FIG. 2.
Figure 8B:
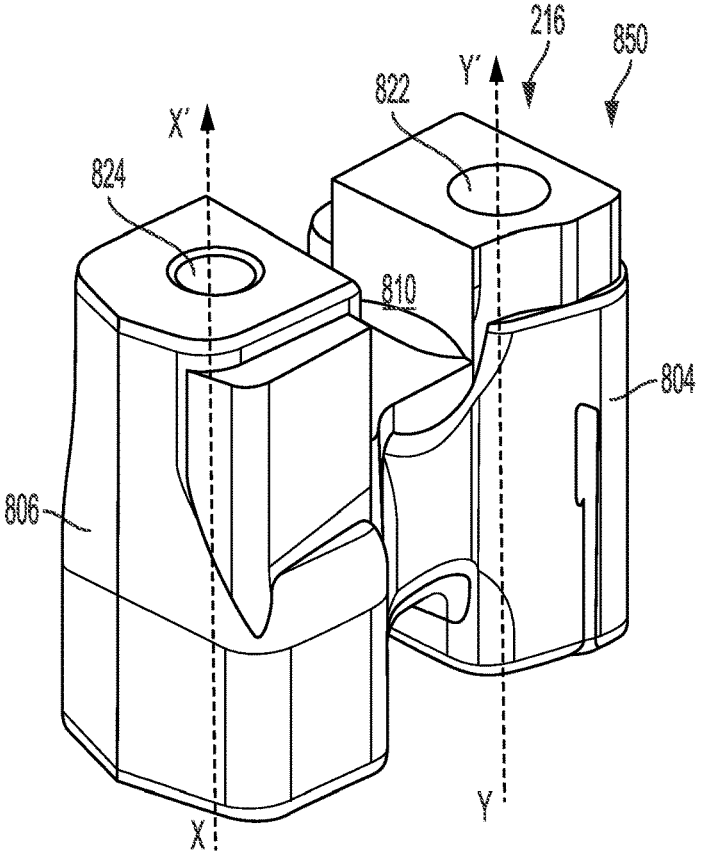
FIG. 8B shows a perspective view of a rocker pedestal supporting the straight rocker shaft of FIG. 2.
Figure 9B:
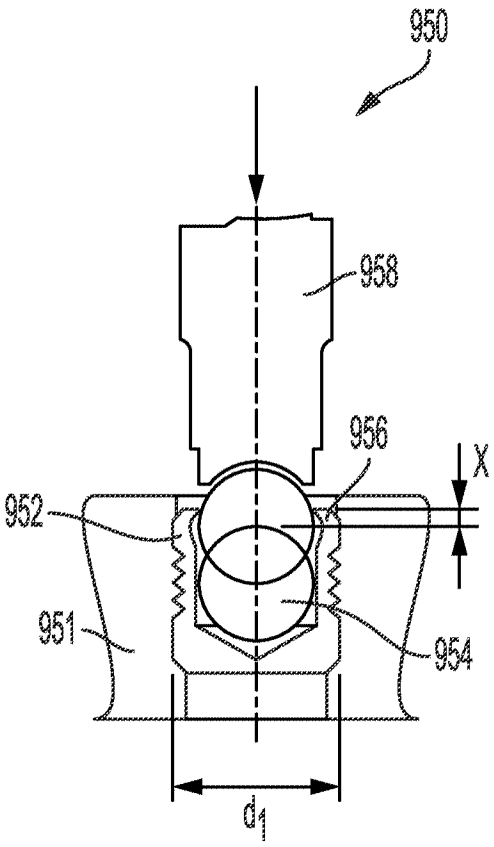
FIG. 9B shows a mechanism for plugging the end of the rocker shaft.
Figure 9A:
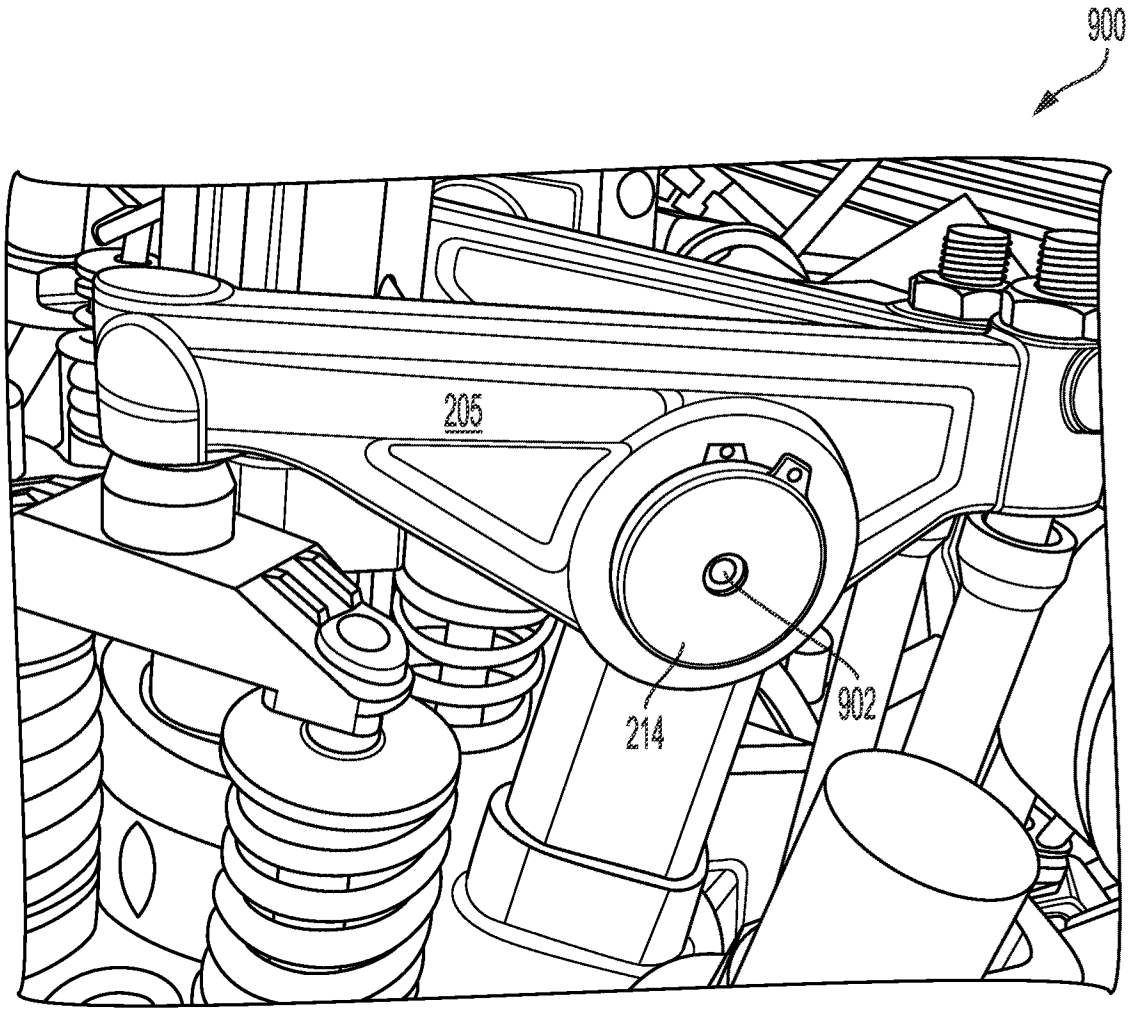
FIG. 9A shows plugging of an end of the straight rocker shaft of FIG. 2.

An engine system, as shown by FIG. 1, may include one or more rocker arm assemblies for actuating cylinder valves of the engine cylinder. Different views of two rocker assemblies, including a straight rocker shaft, coupled to two engine valves are shown in FIGS. 2-4. A first rocker arm and a second rocker arm coupled to an engine cylinder is shown in FIGS. 5A-6B. A valve side elephant foot assembly such as shown in FIG. 7, may couple one end of a rocker arm to a valve train. A rocker pedestal supporting the straight rocker shaft is shown in FIGS. 8A-8B. An end of the straight rocker shaft may be plugged as shown in FIGS. 9A-9B.

Referring to FIG. 1, a block diagram of an embodiment of a vehicle system 100 (e.g., engine system) is shown. In the illustrated embodiment, the vehicle system is a rail vehicle 106 (e.g., locomotive) that can run on a rail 102 via a plurality of wheels 112. The engine system may be disposed in a vehicle. As depicted, the rail vehicle includes an engine 104, and the engine includes a plurality of combustion chambers (e.g., cylinders). The cylinders of the engine may receive fuel (e.g., diesel fuel) from a fuel system 103 via a fuel conduit 107. In some examples, the fuel conduit may be coupled with a common fuel rail and a plurality of fuel injectors.

The engine may receive intake air for combustion from an intake passage 114. The intake air includes ambient air from outside of the vehicle flowing into the intake passage through an air filter 160. The intake passage may include and/or be coupled to an intake manifold of the engine. During operation, exhaust gas resulting from combustion in the engine may be supplied to an exhaust passage 116. Exhaust gas flows through the exhaust passage, to a muffler 117, and out of an exhaust stack 119 of the rail vehicle.

Each cylinder of engine may include one or more intake valves and one or more exhaust valves. For example, a cylinder may include at least one intake valve and at least one exhaust valve located at an upper region of cylinder. The intake valve and the exhaust valve may be actuated via respective cam actuation systems coupled to respective rocker arm assemblies. Cam actuation systems may each include one or more cams and may utilize one or more of cam profile switching (CPS), variable cam timing (VCT), variable valve timing (VVT) and/or variable valve lift (VVL) systems that may be operated by controller to vary valve operation. The position of intake valve and exhaust valve may be determined by valve position sensors. In alternative embodiments, the intake and/or exhaust valve may be controlled by electric valve actuation. For example, a cylinder may alternatively include an intake valve controlled via electric valve actuation and an exhaust valve controlled via cam actuation including CPS and/or VCT systems.

As depicted in FIG. 1, the engine may be coupled to an electric power generation system, which may include an alternator/generator 122 and electric traction motors 124. In one example, the alternator/generator may include a direct current (DC) generator. In other embodiments, the engine may be a diesel engine, a gasoline engine, a biodiesel engine, an alcohol or hydrogen engine, a natural gas engine (spark or compression ignition), or a combination of two or more of the foregoing that generates a torque output during operation. That torque may be transmitted to the electric generator or alternator through a mechanical coupling from the engine.

As depicted herein, six pairs of traction motors correspond to each of six pairs of motive wheels of the rail vehicle. In another example, alternator/generator may be coupled to one or more resistive grids 126. The resistive grids may dissipate excess engine torque and/or electricity generated by traction motors in dynamic braking mode via heat produced by the grids from generated electricity.

The vehicle system may include a turbocharger 120 that may be arranged between the intake passage and the exhaust passage. In some embodiments, the turbocharger may be replaced with a supercharger. The turbocharger increases air charge of ambient air drawn into the intake passage in order to provide greater charge density during combustion to increase power output and/or engine-operating efficiency. As shown in FIG. 1, the turbocharger may include a compressor 121 (disposed in the intake passage) which may be at least partially driven by a turbine 123 (disposed in the exhaust passage). While in this case a single turbocharger may be included, the system may include multiple turbine and/or compressor stages. A temperature sensor 125 may be positioned in the exhaust passage, upstream of an inlet of the turbine. As shown in FIG. 1, a wastegate 127 may be disposed in a bypass passage around the turbine and may be adjusted, via actuation from controller 110, to increase or decrease exhaust gas flow through the turbine. For example, opening the wastegate (or increasing the amount of opening) may decrease exhaust flow through the turbine and correspondingly decrease the rotational speed of the compressor. As a result, less air may enter the engine, thereby decreasing the combustion air-fuel ratio.

The vehicle system also may include a compressor bypass passage 140 coupled directly to the intake passage, upstream of the compressor and upstream of the engine. In one example, the compressor bypass passage may be coupled to the intake passage, upstream of the intake manifold of the engine. The compressor bypass passage may divert airflow (e.g., from before the compressor inlet) away from the engine (or intake manifold of the engine) and to atmosphere. A compressor bypass valve (CBV) 142 may be positioned in the compressor bypass passage and may include an actuator actuatable by the controller to adjust the amount of intake airflow diverted away from the engine and to atmosphere.

In some embodiments, the vehicle system may further include an aftertreatment system coupled in the exhaust passage upstream and/or downstream of the turbocharger. In one embodiment, the aftertreatment system may include a diesel oxidation catalyst (DOC) and a diesel particulate filter (DPF). In other embodiments, the aftertreatment system may additionally or alternatively include one or more emission control devices. Such emission control devices may include a selective catalytic reduction (SCR) catalyst, three-way catalyst, NOx trap, or various other devices or systems.

The vehicle system shown in FIG. 1 does not include an exhaust gas recirculation (EGR) system. However, in alternate embodiments the vehicle system may include an EGR system coupled to the engine. The EGR system may route exhaust gas from the exhaust passage of the engine to the intake passage downstream of the turbocharger. In some embodiments, the exhaust gas recirculation system may be coupled exclusively to a group of one or more donor cylinders of the engine (also referred to a donor cylinder system). Also not shown in FIG. 1 is an alternative embodiment that includes an aftertreatment system that receives exhaust coming from the engine during operation.

The vehicle may include a controller to control various components and operations related to the vehicle. As an example, various components of the vehicle system may be coupled to the controller via a communication channel or data bus. In one example, the controller may include a computer control system. The controller may additionally or alternatively include a memory holding non-transitory computer readable storage media (not shown) including code for enabling on-board monitoring and control of vehicle operation.

The controller may receive information from a plurality of sensors and may send control signals to a plurality of actuators. The controller, while overseeing control and management of the vehicle, may receive signals from a variety of engine sensors. The signals may be used to determine operating parameters and operating conditions, and correspondingly adjust various engine actuators to control operation of the vehicle. For example, the engine controller may receive signals from various engine sensors including, but not limited to, engine speed, engine load (derived from fueling quantity commanded by the engine controller, fueling quantity indicated by measured fuel system parameters, averaged mean-torque data, and/or electric power output from the alternator or generator), mass airflow amount/rate (e.g., via a mass airflow meter), intake manifold air pressure, boost pressure, exhaust pressure, ambient pressure, ambient temperature, exhaust temperature (such as the exhaust temperature entering the turbine, as determined from the temperature sensor), particulate filter temperature, particulate filter back pressure, engine coolant pressure, exhaust oxides-of-nitrogen quantity (from NOx sensor), exhaust soot quantity (from soot/particulate matter sensor), exhaust gas oxygen level sensor, or the like. Correspondingly, the controller may control the vehicle by sending commands to various components such as the traction motors, the alternator/generator, cylinder valves, fuel injectors, a notch throttle, the compressor bypass valve (or an engine bypass valve in alternate embodiments), a wastegate, or the like. Other actively operating and controlling actuators may be coupled to various locations in the vehicle.

FIG. 2 shows a perspective view 200 of an arrangement of rocker assemblies including a straight rocker shaft 214. A first rocker arm assembly 204 and a second rocker arm assembly 206 may be in an engine cylinder housed atop an engine block 228. The rocker assemblies may be covered on the top by a cam cover. A first rocker arm 205, extending along the B-B' axis, and a second rocker arm 207, extending along the C-C' axis, may not be parallel to each other. The axes B-B' and C-C' may diverge at the tips of the respective rocker arms connecting to cylinder valves.

The first rocker arm 205 may be twisted along its length to form an inclined top section whereas the second rocker arm 207 may extend straight along the C-C' axis. Therefore, the first rocker arm 205 and the second rocker arm 207 may not be identical. A first end (tip) of a first rocker arm 205 may be coupled to a first valve lift mechanism (valve train) 210 of an intake valve and a first end (tip) of a second rocker arm 207 may be coupled to a second valve lift mechanism (valve train) 212 of an exhaust valve of the engine cylinder. Each of the first valve lift mechanism 210 and the second valve lift mechanism 212 may include a pair of return springs coupled to a valve stem and a valve attached to an end of the valve stem distal from the return springs. A second end of the first rocker arm 205 may be coupled to a first drive cam via a first pushrod 209 and a second end of the second rocker arm 207 may be coupled to a second drive cam via a second pushrod (not shown).

Each of the first rocker arm 205 and the second rocker arm 207 may have openings (bores) in their respective centers. A continuous, straight, central shaft 214 may pass through each of the respective central openings in the first rocker arm 205 and the second rocker arm 207 along an A-A' axis. A first bush bearing 224 may enclose the central shaft 214 within the first central opening in the first rocker 205 and a second bush bearing 226 may enclose the central shaft 214 within the second central opening in the second rocker 205. Each rocker arm may oscillate about the central shaft 214 to selectively open and close the valve coupled to the rocker arm.

The first rocker arm 205 may form an angle, donated by $\alpha$, with the central shaft 214. As an example, $\alpha$ may be the angle between the longitudinal axis A-A' of the central shaft and the longitudinal axis B-B' of the first rocker arm 205. The second rocker arm 207 may form another angle, donated by $\beta$, with the central shaft 214. As an example, $\beta$ may be the angle between the longitudinal axis A-A' of the central shaft and the longitudinal axis C-C' of the second rocker arm 207. In one example, the angle $\alpha$ may not be equal to the angle $\beta$ with the angle $\alpha$ being smaller than angle $\beta$. In one example, angle $\alpha$ may be 90° while angle $\alpha$ may be an acute angle. Said another way, while the second rocker arm 207 may be perpendicular to the straight, central shaft 214, the first rocker arm 205 may form an acute angle with the straight, central shaft 214. Details of the first rocker arm 205 and the second rocker arm 207 may be elaborated further in relation to FIGS. 5A-6B.

Pillars of a rocker pedestal 216 may support portions of the central shaft 214 not passing through openings within the rocker arms such as a portion of the central shaft 214 between two rocker arms or beyond the second rocker arm 207. The rocker pedestal 216 may include two pillars in face sharing contact with such portions of the central shaft 214 not passing through openings within the rocker arms. The two pillars may be of equal height and may be symmetric. While the portion of the central shaft 214 that passes through the openings within the rocker arms are not in contact with the pillars of rocker pedestal 216. The rocker pedestal 216 may be positioned between the cylinder head housed on the engine block 228 and the central shaft 214. Lubricating oil may be supplied from an oil sump at the cylinder head to the rocker arms via each of the pillars of rocker pedestal 216 and the central shaft 214. Details of the rocker pedestal 216 are elaborated further in relation to FIGS. 8A-8B.

FIG. 3 shows a top-view 300 of the rocker assemblies as seen in FIG. 2. FIG. 4 shows a cross-section 400 of the top-view 300 of the rocker assemblies of FIG. 3. Components of the rocker assemblies previously introduced are numbered similarly and not reintroduced. From the top-view, the central portion 305 of the first rocker arm 205 may be twisted causing the first rocker arm 205 to be inclined relative to the central axis A-A' of the central shaft passing through openings of both the rocker arms. The twisted central portion 305 may provide a controlled level of stiffness with a determined inertia and mass.

The two rocker arms 205 and 207 may each include a top section, also referred herein as I-section with a circular opening below the respective I-sections. A first opening of the first rocker arm 205 may align with the second opening of the second rocker arm 207 to allow a straight rocker shaft to pass through each of the first rocker arm 205 and the second rocker arm 207. By using a straight central shaft 214, manufacturability of the central shaft 214 may be eased. By using rocker arms shaped differently from each other and coupled via a straight central shaft, the two rocker arm assemblies may be efficiently packed within the cylinder head, thereby improving packaging of the engine.

A first lash adjuster 312 may be coupled to an end of the first rocker arm 205 coupled to the first pushrod 209. The first lash adjuster 312 may be inserted into a bore at the end of the rocker arm 205. The first lash adjuster may have a threaded surface and may be fastened within the bore via a first nut 316. A second lash adjuster 314 may be coupled to an end of the second rocker arm 207 coupled to the second pushrod 219. The second lash adjuster 314 may be inserted into a bore at the end of the second rocker arm 207. The second lash adjuster 314 may have a threaded surface and may be fastened within the bore via a second nut 318.

A lash adjuster such as lash adjusters 312 and 314 may adjust valve lash ensuring desired valve seating, engine air flow, and fuel management. Valve lash may be a mechanical clearance in a valve train between a camshaft and a valve in an internal combustion engine. Valve lash may be intended to provide a maximum amount of valve opening corresponding to a high point of the camshaft lobe (translated via the pushrod connected to the rocker arm) and ensure that the valve may be closed at a low point of the camshaft lobe (translated via the pushrod connected to the rocker arm). The lash adjusters may be hydraulic lash adjuster that use engine oil pressure to maintain a desired valve train clearance.

Further, a first elephant foot assembly 322 may be coupled to another end of the first rocker arm 205 coupled to the first valve lift mechanism 210. A second elephant foot assembly 324 may be coupled to another end of the second rocker arm 207 coupled to the second valve lift mechanism 212. Details of an example elephant foot assembly may be further elaborated in FIG. 7.

A fuel injector may be inserted into a frame 328 included between the first valve lift mechanism 210 and the second valve lift mechanism 212. Lubricating oil may be supplied to the tips of each of the rocker arms via an oil channel formed within the central shaft 214. A central, first horizontal oil channel 412 may pass through the center of the rocker shaft 214 along the axis A-A'. Due to the rocker shaft 214 being straight, the central, first horizontal oil channel 412 may also be straight without any bends. Oil may be supplied to the first horizontal oil channel 412 from vertical oil channels within the rocker pedestal 216 via a first inlet 424 and a second inlet 422.

Lubricating oil from the cylinder head may flow vertically through vertical oil channels within pillars of the rocker pedestal 216 and then enter the first horizontal oil channel 412 at each of the first inlet 424 and the second inlet 422. The oil may horizontally flow through the first horizontal oil channel 412 and then intermittently flow to a second horizontal oil channel through the rocker arm (along its length) which leads to the tip of the rocker arm coupled to a valve lift mechanism.

The first horizontal oil channel 412 may be sealed at each end of the rocker shaft using a plug. FIG. 9A shows an example 900 of plugging of an end of the straight rocker shaft of FIG. 2 and FIG. 9B shows a mechanism 950 for plugging the end of the rocker shaft. A first horizontal passage may longitudinally pass through the center of the rocker shaft 214 from one end to another for transporting lubricating oil from a cylinder head to respective tips of the rocker arms.

To confine the lubricating oil within the first horizontal passage, each end of the passage may be sealed. A seal 902 formed at one end of the first horizontal passage. The seal 902 may be formed via the mechanism 950. Suitable seals may include a control valve plug (CV plug) or a ball valve.

A bore 952 may be drilled into the substrate 951 to form a plug within a substrate 951. The bore may have an outer diameter of dl. A spherical object such as a ball enclosed within a shell 956 may be pushed into the bore 952 via a rod 958 to plug the bore 952 with the spherical object enclosed within the shell 956.

Figure 5A:
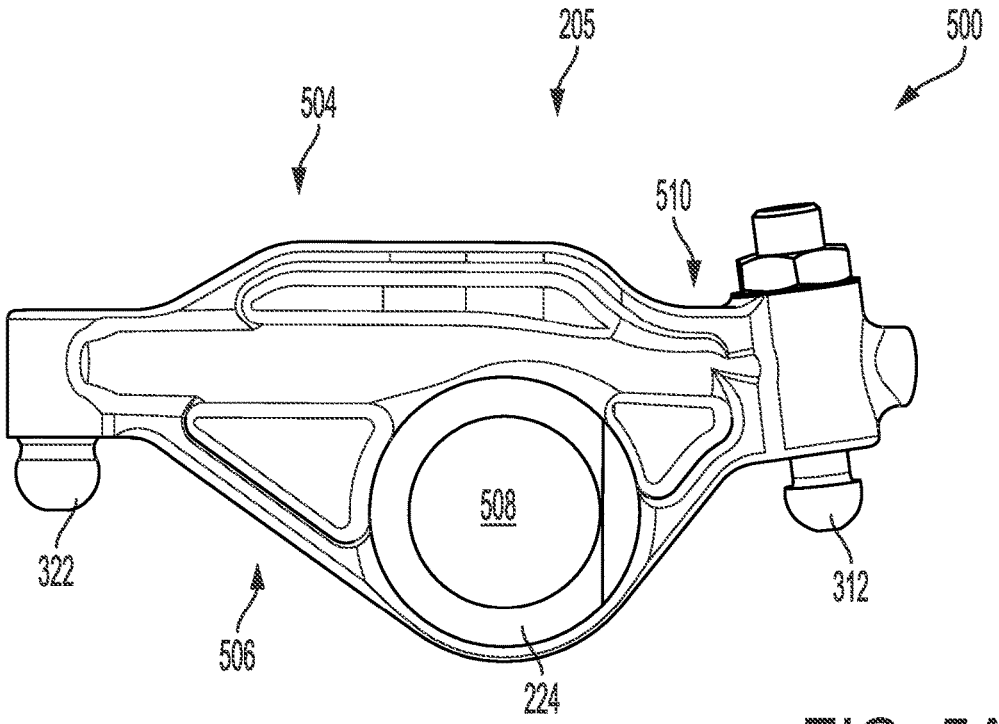
FIG. 5A shows a front view of a first rocker arm coupled to an engine cylinder.
Figure 5B:
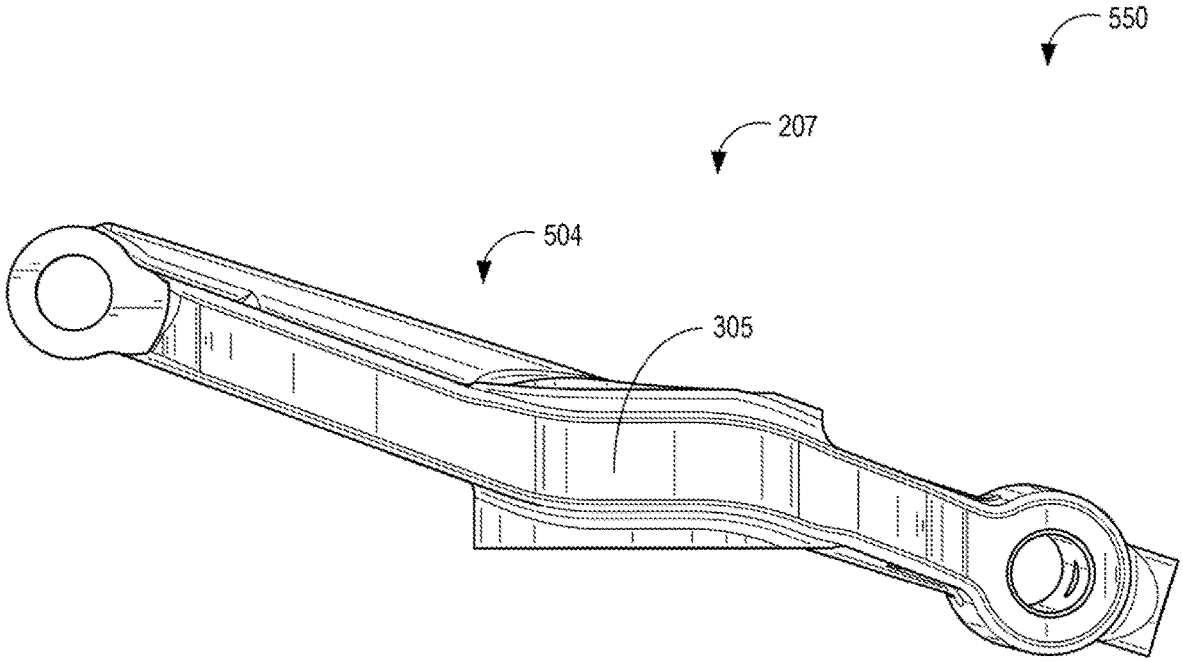
FIG. 5B shows a top view of the first rocker arm coupled to the engine cylinder.

FIG. 5A shows a front view 500 and FIG. 5B shows a top view 550 of a first rocker arm 205 coupled to an engine cylinder. As an example, the first rocker arm 205 may be coupled to an intake valve-train of the cylinder via the elephant foot assembly 322 housed at one end of the rocker arm 205. The first rocker arm 205 may include a top section 504, also referred herein as I-section and a triangular section 506 directly below the top section 504. The top section 504 of the first rocker arm may not be straight and the central portion 305 of the first rocker arm 205 may be twisted or inclined causing the first rocker arm 205 to be inclined relative to a longitudinal axis of the rocker arm. The twisted central portion 305 may be optimized to provide increased stiffness with lower inertia and mass. The triangular section 506 may include a first central bore 508 which may be lined by a bush bearing 224. A straight rocker shaft may pass through the first central bore 508. Due to the twisted nature of the top section of the first rocker arm, the longitudinal axis of the rocker shaft may not be perpendicular to a central axis of the first central bore 508.

A first lash adjuster 312 may be coupled to an end of the first rocker arm 205 coupled to a first pushrod. In order to service the lash adjuster, as needed, a tool may be inserted through a cutout 510 in the top section 504 of the first rocker arm 205. The cutout 510 may be positioned between the twisted central portion 305 and the first lash adjuster 312. Due to the presence of the cutout, a clearance may be provided between the first rocker arm 205 and an adjoining fuel injector, thereby improving serviceability of the lash adjuster 312.

Figure 6A:
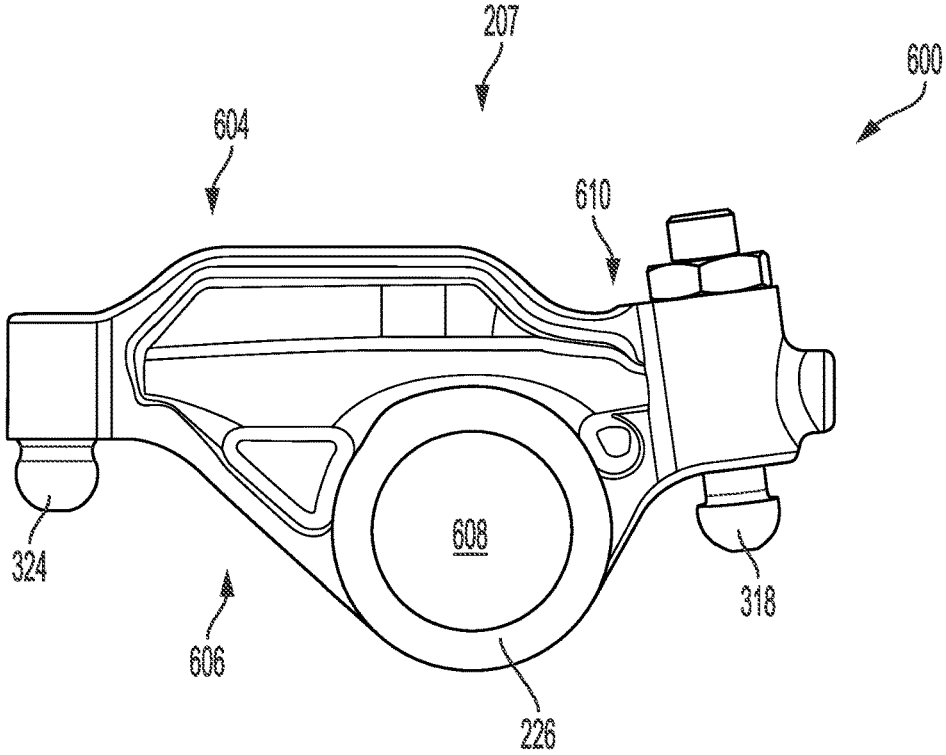
FIG. 6A shows a front view of a second rocker arm coupled to an engine cylinder.
Figure 6B:
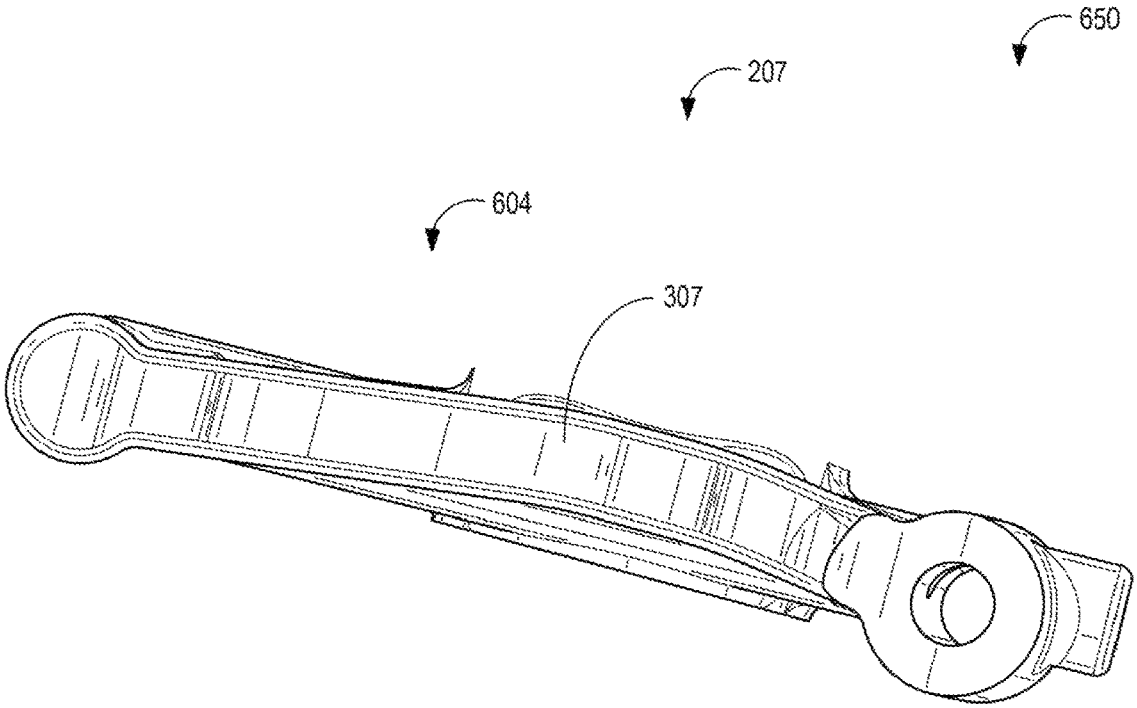
FIG. 6B shows a top view of the second rocker arm coupled to the engine cylinder.

FIG. 6A shows a front view 600 and FIG. 6B shows a top view 650 of a second rocker arm 207 coupled to an engine cylinder. As an example, the second rocker arm 207 may be coupled to an exhaust valve-train of the cylinder via the elephant foot assembly 324 housed at one end of the rocker arm 207. The second rocker arm 207 may include a top section 604, also referred herein as I-section and a triangular section 606 directly below the top section 604. The top section 604 of the second rocker arm may be straight and unlike the top portion of the first rocker arm 205, the central portion 307 of the second rocker arm 207 may be straight along a longitudinal axis of the rocker arm. The triangular section 606 may include a second central bore 608 which may be lined by a bush bearing 226. A straight rocker shaft mass pass through the second central bore 608. Due to the straight nature of the top section of the second rocker arm, the longitudinal axis of the rocker shaft may be perpendicular to a central axis of the second central bore 608.

A second lash adjuster 318 may be coupled to an end of the second rocker arm 207 coupled to a second pushrod. In order to service the lash adjuster, as needed, a tool may be inserted through a cutout 610 in the top section 604 of the second rocker arm 605. The cutout 610 may be positioned between the straight central portion 307 and the second lash adjuster 318. Due to the presence of the cutout, a clearance may be provided between the second rocker arm 207 and an adjoining fuel injector, thereby improving serviceability of the lash adjuster 318.

FIG. 7 shows an example cross-section 700 of a valve side elephant foot assembly 322 coupled to a first rocker arm 205. The valve side elephant foot assembly 322 may couple one end of first rocker arm 205 to a valve train. The elephant foot assembly may be inserted in a slot at a tip of the first rocker arm 205 at which a cylinder valve train may be coupled. The elephant foot assembly 322 may include a rectangular upper portion and a spherical lower portion. The elephant foot assembly 322 may be press fitted into the slot of the rocker arm. A through hole 712 may be drilled between a top surface of the elephant foot assembly and a top surface of the rocker arm 205. The through hole 712 may facilitate in dis-assembly of the elephant foot assembly 322 from the rocker arm if needed.

The spherical lower portion (ball) of the elephant foot may form a spherical interface 716 with a complementary cup (socket) shaped geometry of a valve train 210 component. The edge of the socket receiving the elephant foot may become thin and crimped after assembly. The thickness of the socket edge may be reduced and annealed (made softer) to facilitate ease of assembly. After assembly the crimped edge may avert separation of the ball from the socket. During actuation of the valve train (such as opening of the valve), the elephant foot assembly may be the contact point through which the lowering motion of the rocker arm may be translated to the valve train 210. During actuation of the valve train, the elephant foot assembly may rotate about its central axis. The sphere on sphere ball joint at the interface 716 may reduce sliding motion between the elephant foot and the valve train component during actuation of the valve train. A vertical channel 708 may longitudinally pass through the elephant foot assembly to supply lubricating oil received through a horizontal channel 722 of the rocker arm to the valve train 210.

FIG. 8A shows a front view 800 and FIG. 8B shows a perspective view 850 of a rocker pedestal 216 (as seen in FIG. 2) supporting the straight rocker shaft 214 passing through two rocker arm assemblies. The rocker pedestal may include a first pillar 804 and a second pillar 806 parallel to each other. The pillars may be separated by a bridge 808.

Each of the first pillar 804 and the second pillar 806 may be of equal height (distance between base 832 and top 830), denoted by H, relative to a base 832 of the rocker pedestal 216. The top surfaces of the two pillars may be coplanar while the bases of the two pillars may also be coplanar. The bridge 808 may join the two pillars at their respective central positions with a rectangular gap 810 between two pillars above the bridge 808 and an arcuate gap 812 between two pillars below the bridge 808. The first pillar 804 and the second pillar 806 may be symmetric about the bridge 808. Each of the first pillar 804 and the second pillar 806 may be tapering in shape with being wider at the base 832 and narrower at the top 830.

The first pillar 804 may support a first section of the rocker shaft between a first rocker arm and a second rocker arm while the second pillar 806 may support a second section of the rocker shaft beyond the second rocker arm. Due to the rocker shaft being straight, the sections of the rocker shaft supported by the pillars of the rocker pedestal may be at equal height.

Lubricating oil may be supplied to a first, horizontal channel passing through the rocker shaft via vertical channels within the pillars of each of the first pillar 804 and the second pillar 806. A first vertical oil channel 822 may pass longitudinally, along the Y-Y' axis through the first pillar 804 and a second vertical oil channel 824 may pass longitudinally, along the X-X' axis through the second pillar 806. The first vertical oil channel 822 and the second vertical oil channel 824 may be parallel. Each of the first vertical oil channel 822 and the second vertical oil channel 824 may originate from an engine oil sump at the cylinder head and terminate at the first, horizontal channel passing through the rocker shaft.

A first inclined rocker arm and a second straight rocker arm may be coupled to a cylinder head. A straight rocker shaft may connect the first rocker arm to the second rocker arm. A rocker pedestal, including at least two pillars, may support a section of the straight rocker arm. In one embodiment, the at least two pillars having an equal height. In other embodiments, the pillar heights may differ.

FIGS. 2-8B show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

As used herein, an element or step recited in the singular and proceeded with the word "a" or "an" should be understood as not excluding plural of said elements or steps, unless such exclusion is explicitly stated. References to "one embodiment" or "one example" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional elements not having that property. The terms "including" and "in which" are used as the plain-language equivalents of the respective terms "comprising" and "wherein." Moreover, the terms "first," "second," and "third," etc., are used merely as labels, and are not intended to impose numerical requirements or a particular positional order on their objects.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A system for an engine, the system comprising:

a straight rocker shaft passing through a first rocker arm and a second rocker arm, the first rocker arm being shaped differently from the second rocker arm; and a rocker pedestal supporting the straight rocker shaft, the rocker pedestal including at least two pillars of equal height which are connected to each other via a bridge, wherein a first pillar of the at least two pillars supports a first portion of the straight rocker shaft extending between the first rocker arm and the second rocker arm, and wherein a second pillar of the at least two pillars supports a second portion of the straight rocker shaft extending beyond the second rocker arm.

2. The system of claim 1, wherein the first rocker arm has an inclined upper portion with a first opening formed directly below the inclined upper portion, and the inclined upper portion is not perpendicular to a central axis of the first opening, and wherein the second rocker arm has a straight upper portion with a second opening formed directly below the straight upper portion, and the straight upper portion is perpendicular to a central axis of the second opening.

3. The system of claim 2, wherein the straight rocker shaft passes through the first opening and the second opening.

4. The system of claim 2, wherein the first opening and the second opening each include a bush bearing configured to contact the straight rocker shaft.

5. The system of claim 1, wherein each rocker arm has a continuous upper section and an opening formed directly below the continuous upper section, the continuous upper section of each rocker arm being including a first end coupled to a pushrod, and a second end coupled to a valve train.

6. The system of claim 1, wherein each rocker arm is configured to oscillate about the straight rocker shaft.

7. The system of claim 1, wherein the first rocker arm has an inclined first upper section and wherein the second rocker arm has a straight second upper section.

8. The system of claim 7, wherein a central portion of the inclined first upper section is inclined with respect to the straight rocker shaft.

9. The system of claim 7, wherein the straight second upper section extends perpendicular to the straight rocker shaft.

10. The system of claim 7, wherein the inclined first upper section extends at a non-perpendicular angle with respect to the straight rocker shaft arm.

11. The system of claim 1, further comprising a first vertical channel passing through the first pillar and a second vertical channel passing through the second pillar, each vertical channel originating from a cylinder head of the engine and terminating at a horizontal channel passing through the straight rocker shaft.

12. The system of claim 11, wherein the horizontal channel is entirely linear.

13. The system of claim 11, wherein the horizontal channel is coaxial with the straight rocker shaft and extends from a first end of the straight rocker shaft to a second end of the straight rocker shaft so as to carry lubricating oil.

14. The system of claim 1, wherein the first rocker arm is configured to actuate an intake valve and the second rocker arm is configured to actuate an exhaust valve.

15. A system for an engine, the system comprising:

a first rocker arm including:

a first central bore formed below a first upper section, a first end coupled to a first valve, and a second end coupled to a first pushrod;

a second rocker arm including:

a second central bore formed below a second upper section, a first end coupled to a second valve, and a second end coupled to a second pushrod;

a rocker shaft passing straight through the first central bore and the second central bore; and a rocker pedestal supporting the rocker shaft, the rocker pedestal including at least two pillars of equal height which are connected to each other via a bridge, wherein a first pillar of the at least two pillars supports a first portion of the rocker shaft extending between the first rocker arm and the second rocker arm, and wherein a second pillar of the at least two pillars supports a second portion of the rocker shaft extending beyond the second rocker arm.

16. The system of claim 15, wherein the first upper section is curved and the second upper section is straight.

17. A system for an engine, the system comprising:

a first inclined rocker arm and a second straight rocker arm in a cylinder head of the engine;

a straight rocker shaft connecting the first inclined rocker arm to the second straight rocker arm; and a rocker pedestal including at least two pillars configured to support sections of the straight rocker shaft, the at least two pillars having an equal height and being connected to each other via a bridge, wherein a first pillar of the at least two pillars supports a first portion of the straight rocker shaft extending between the first rocker arm and the second rocker arm, and wherein a second pillar of the at least two pillars supports a second portion of the straight rocker shaft extending beyond the second rocker arm.

18. The system of claim 17, wherein the first inclined rocker arm makes a first angle with the straight rocker shaft and the second straight rocker arm makes a second angle with the straight rocker shaft, the first angle being different from the second angle.

* * * * *